United States Patent [19]

Shumaker

[11] 4,411,584

[45] Oct. 25, 1983

[54] OPTIMIZED EARTHWORKING TOOL OPERATING LINKAGE

[75] Inventor: John F. Shumaker, Mt. Pleasant, Iowa

[73] Assignee: J. I. Case Company, Racine, Wis.

[21] Appl. No.: 228,606

[22] Filed: Jan. 26, 1981

[51] Int. Cl.[3] ..... E02F 3/32

[52] U.S. Cl. ..... 414/694; 414/917; 414/685; 37/103

[58] Field of Search ..... 414/694, 685, 686, 687, 414/722, 697, 917; 37/103, 117.5, 118

[56] References Cited

U.S. PATENT DOCUMENTS

| | | | |
|---|---|---|---|
| 2,656,058 | 10/1953 | Foote | 414/917 X |
| 4,026,428 | 5/1977 | Shumaker | 414/694 |
| 4,066,296 | 1/1978 | Ray, Jr. et al. | 414/917 X |
| 4,212,404 | 6/1980 | Campbell et al. | 414/694 X |
| 4,212,582 | 7/1980 | Stecklein | 414/694 |
| 4,218,171 | 8/1980 | Guinot | 414/694 |
| 4,239,444 | 12/1980 | Schmelzer | 414/685 |

*Primary Examiner*—Joseph E. Valenza
*Assistant Examiner*—Terrance L. Siemens
*Attorney, Agent, or Firm*—Dressler, Goldsmith, Shore, Sutker & Milnamow, Ltd.

[57] ABSTRACT

An arrangement is described for mounting a hydraulic actuator used to raise and lower a material handling element relative to a base member using a minimum of pivotal connections and using the inherent strength and force producing capabilities of a hydraulic actuator. The hydraulic actuator includes a cylinder, a piston slidably mounted within the cylinder and a piston rod connected to the piston such that hydraulic actuators extended when the material handling element is in its upright or raised position. A pair of articulated connecting links join the piston rod to the material handling element and the base member. The cylinder end of the hydraulic actuator is pivotally connected to the common pivotal connection between the base member and the material handling element. Two specific embodiments are described in detail, one for the bucket mounted at the end of the lift arms of a loader and one in connection with the boom portion of a backhoe mechanism. Under both arrangements, the lifting capability of the material handling element is improved and the speed at which the material handling element is lowered is increased. In both arrangements, the inherent rigidity of the hydraulic actuator is used and the piston rod is protected from external damage when the material handling element is positioned for loading. In both arrangements, the minimum number of pivotal connections is used.

1 Claim, 2 Drawing Figures

OPTIMIZED EARTHWORKING TOOL OPERATING LINKAGE

TECHNICAL FIELD

This invention relates to hydraulically actuated shovels and, more particularly, it is concerned with a mechanism adapted to be mounted on the lift arms of a loader or on the swing tower of a backhoe in such a manner that the lifting capability and the return-to-dig speed of the machine are increased while at the same time minimizing the number of pivotal connections and protecting the hydraulic actuators from damage.

BACKGROUND OF THE INVENTION

It has been a conventional practice in the design of loaders, backhoes and similar machines to mount a material handling element, such as a bucket or boom, pivotally at one end of a base member, such as a lift arm or swing tower, with the hydraulic actuator or cylinder used to rotate the material handling element relative to the base member disposed above the base member. U.S. Pat. Nos. 4,053,075; 3,624,785; 2,645,369 and 3,447,708 are typical examples. Since one end of the hydraulic actuator is pivotally connected to the base member and the other end is pivotally connected to the material handling element, the hydraulic actuator extends in pivoting the material handling element away from the base member. Consequently, the cylinder end or head side of the piston within the actuator is pressurized in lowering the boom of a backhoe or in dumping the bucket of a loader. Similarly, the piston rod side of the piston is pressurized in raising the boom or lifting the bucket to its filled position. Since the piston rod side of the piston has an effective area less than the cylinder head side of the piston, and since the same hydraulic pressure is applied to each side of the piston, the force provided by the hydraulic actuator in lowering the boom of a backhoe is greater than the force provided in raising the boom. Similarly, in the case of a loader, the force provided by the hydraulic actuator in dumping the bucket is greater than the force provided in rolling back the bucket from its dumped to its filled position.

Since the piston rod portion of a hydraulic actuator occupies a certain fraction of the volume of the cylinder on the piston rod side of the piston, it takes a greater volume of fluid to extend the actuator than it takes to retract the actuator. Thus, the speed at which the boom of a backhoe is raised is potentially greater than the speed at which the boom is lowered. Similarly, the speed at which the bucket of a loader is rolled back relative to the lift arm, is potentially greater than the speed at which the bucket is dumped.

From the foregoing it should be clear that the conventional method of mounting hydraulic actuators on backhoes and loaders is just the opposite of what it should be. In other words the greater force capability of a hydraulic actuator should be used in raising the boom of a backhoe or in rolling back the bucket of a loader to its filled position. Conversely, when the boom is lowered or the bucket is dumped, the greatest available lifting force is not needed. All things being equal, the speed at which the boom is lowered and the speed at which the bucket is dumped should be greater than the speed at which the boom is raised or is dumped since the force of gravity is assisting the actuator. Thus, the conventional method of mounting hydraulic actuators on backhoes and loaders does not use the inherent capabilities of hydraulic actuators to the optimum extent.

Turning for the present to a backhoe, a backhoe implement is usually attached to the rear end of a tractor or similar machine in such a manner that the tractor operator or driver has to reverse his position on the tractor to operate the backhoe. Thus, the tractor driver faces the rear end of the tractor when the controls of the backhoe are operated. Since the bucket portion of the backhoe is pivoted towards the dipper stick when it is being filled, and since the dipper stick is pivoted to fold towards the boom of the backhoe when the loaded bucket is raised, the boom effectively obscures the tractor operator's view of the dipper stick, and more significantly, the inside of the bucket. In order to provide adequate lift capability and balance, it has been conventional practice to provide two hydraulic actuators on either side of the boom with the piston rod ends pivotally connected to the boom and the cylinder ends or cylinders pivotally connected to the swing tower. Thus, for the most part, the tractor or backhoe operator's direct line of sight of the bucket is shielded or obscured by the boom and the two hydraulic actuators used to operate the boom. In one machine, the overall width of the backhoe boom is about six inches and the overall width of each of the two hydraulic actuators used to operate the boom is on the order of 4.5 inches. Thus, a barrier of approximately 15 inches is interposed between the backhoe operator and the bucket.

Those skilled in the art known that there are many occasions during the operation of a backhoe when the backhoe operator must have an unobscured view of the bucket. This is particularly true when the bucket is being manipulated at close quarters to another worker or helper or when the backhoe bucket is being used close to formwork or scaffolding which could be easily damaged due to inadvertent or uncontrolled movement of the bucket, boom or dipper stick.

The conventional practice of flanking the boom by two hydraulic actuators or cylinders is especially troublesome when the backhoe is used to dig a narrow, deep trench. This is because the hydraulic actuators for the backhoe boom are relatively weak compared to the boom itself. This is especially true when the hydraulic actuators are fully extended, as would be the case when the boom is lowered inside a trench and a lateral force is imposed on the hydraulic actuator. This is an inherent weakness of all hydraulic actuators when they are fully extended. Hydraulic actuators, because they are designed to produce force in a direction of their longtitudinal axis, are inherently weak or provide relatively little resistance to severe lateral forces when they are fully extended. The only resistance against a force perpendicular to the longitudinal axis of the hydraulic actuator is that provided by the seals or rings on the piston and those seals between the piston rod and the cylinder. These seals, of course, are not intended to resist the lateral motion of the piston rod to any great extent. Comparatively speaking, the boom is a relatively strong structure and can easily resist forces or thrusts imposed laterally on the boom. Thus, if the boom is flanked by two hydraulic actuators it cannot be used to protect those actuators from lateral forces such as those which would be expected when the boom is driven against the walls of a deep, narrow trench.

In the case of a loader or bucket-loader, the conventional method of mounting a hydraulic actuator such that it is fully extended when the bucket is positioned for filling also subjects the hydraulic actuator to lateral forces just when it is least able to absorb or resist those forces. Those skilled in the art know that when a bucket is being filled the tractor operator frequently must "jockey" the position of the bucket and the tractor so that the bucket is completely filled when the bucket is "rolled back". While the lift arms are relatively rigid, the hydraulic actuator nevertheless is subjected to unbalanced lateral forces when the bucket is being filled. On the other hand, once the bucket has been raised to its filled position the bucket remains relatively stationary and static relative to the lift arms as the tractor is driven to another location. However, according to conventional practice, this is exactly when the hydraulic actuator is or has its greatest rigidity (i.e., it is contracted). Thus, even in the case of a loader, the conventional method of mounting hydraulic actuators not only fails to use the inherent force-producing capabilities of the hydraulic actuator but also subjects the hydraulic actuator to dynamic loadings at a time when it is least able to resist lateral forces.

Hydraulic actuators of the type used in conjunction with earth working implements such as loaders and backhoes are also vulnerable to damage in that the polished piston rods emerging or extending from the cylinder portion of the actuator are exposed to damage from falling rocks and other debris which may occasionally spill over the rear edge of the bucket of a loader or from the walls of the trench or excavation in which the backhoe is inserted. If the hydraulic actuators are so mounted that they are in their contracted position when they are most likely to have dirt or other debris dumped upon them, the polished piston rods will be protected and the seal between the piston rod and the cylinder will be less likely to be damaged. U.S. Pat. No. 3,197,050 describes this consideration in reference to a loader mechanism. However, even where the principle was recognized, the linkage was relatively complicated and employed a large number of pivotal connections and relatively expensive trunion mounted hydraulic actuators. A simplified linkage which incorporates the inherent capabilities of a hydraulic actuator has heretofore eluded those skilled in the art.

Thus, it should be appreciated that a backhoe design or loader design which would use the inherent force and speed capabilities of a hydraulic actuator to manipulate a boom or a bucket and which would mount the actuator in such a manner that it would be best able to absorb side thrusts or lateral forces, would not only improve the overall productivity of the machine but would also reduce maintenance and repair costs. A design change that would achieve these benefits, while at the same time reducing the overall cost of producing the backhoe or loader mechanism would be well accepted by the industry and would go far towards achieving an optimum machine design.

SUMMARY OF THE INVENTION

In accordance with the present invention a mounting arrangement is provided for rotating a material handling element relative to a base member using a hydraulic actuator positioned relative to the material handling element and the base member such that the hydraulic actuator extends when the greatest force is required and contracts when the greatest side thrusts or forces are likely to be imposed upon it. Moreover, since the hydraulic actuator is moved to its contracted position when the load is removed from the material handling element, the time required to place the material handling element in a position where it can accept another load is reduced and the smooth finish of the piston rod is protected from damage. Furthermore, in the case of a backhoe, the hydraulic actuator is centered between the two sides of the boom such that the machinery operator's overall view of the bucket is improved while the boom itself shields the hydraulic actuator from that damage which would occur if the boom were thrust against the sidewalls of a trench or similar abutment. Finally, the mounting arrangement uses at most three pivotal connections in addition to that pivotal connection already existing between the material handling element and the base member. Thus, the inherent dynamic and static efficiencies of a hydraulic actuator are fully utilized while using the least number of parts and while protecting the hydraulic actuator from damage.

Two specific embodiments of the invention are described in detail. In each case a pair of articulated links are used to pivotally connect the material handling element with the base member at a spaced distance from the pivotal connection between the base member and the material handling element. A hydraulic actuator is then used to rotate the articulated links relative to each other. The hydraulic actuator is in its contracted position when the material handling element is positioned relative to the base member for accepting a load of material. Since the hydraulic actuator is contracted, it is in its best position for resisting lateral forces and the smooth surface of the extensible piston rod is protected. Since the hydraulic actuator is extended when moving the material handling element away from that position where it was filled or loaded, the greatest force available from the hydraulic actuator is used. Finally, since the hydraulic actuator is moved to its contracted position when dumping the load, the materail handling element is returned to that position where it can be filled in the shortest period of time.

In one embodiment, the cylinder end of the hydraulic actuator is pivotally connected at the common pivotable connection between the boom and the swing tower of a backhoe. In the second embodiment, the cylinder end of the hydraulic actuator is pivotally connected to the pivotable connection between lift arm and the bucket of a loader. In the case of the backhoe, since the bucket is relatively narrow, this mounting arrangement improves the machinery operator's view of the bucket. In the case of a loader, since the bucket is relatively wide and the actuator is contracted, the mounting arrangement improves rigidity of the loader when the bucket is thrust into a pile of material by the tractor in loading the bucket.

In summary, a material handling machine having a backhoe and loader installed on the same tractor or frame and having hydraulic actuators mounted in such a way that they extend in raising the boom or pivoting the bucket upwardly offers the following advantages over conventional mounting arrangements:

(1) The boom portion of a backhoe has a greater lift capability since the larger cylinder end of the piston is pressurized in raising the boom;

(2) The operator's view of the backhoe bucket is improved;

(3) The hydraulic actuator used to operate the boom is protected by the sidewalls of the boom;

(4) The return to trench speed of the boom is increased because less fluid is required to stroke the piston rod side of the hydraulic actuator when lowering the boom;

(5) The dumping speed of the bucket at the end of the loader lift arms is increased because less fluid is required to stroke the piston rod side of the hydraulic actuator when lowering the bucket;

(6) The inherent rigidity of the bucket at the end of the lift arms of a loader is increased relative to a loader having hydraulic actuators which are fully extended when the bucket is in its lowered or dumped position;

(7) For the same lifting capability as in a conventional backhoe or loader mounting arrangement, the diameter of the hydraulic actuator can be reduced; and (8) The smooth walls of the piston rod are housed within the cylinder when abrasive material is likely to be dumped upon them.

Other advantages and features of the present invention will become apparent from the following description, the claims, and the drawings which show illustrative embodiments of the invention.

DETAILED DESCRIPTION

Figure 1:
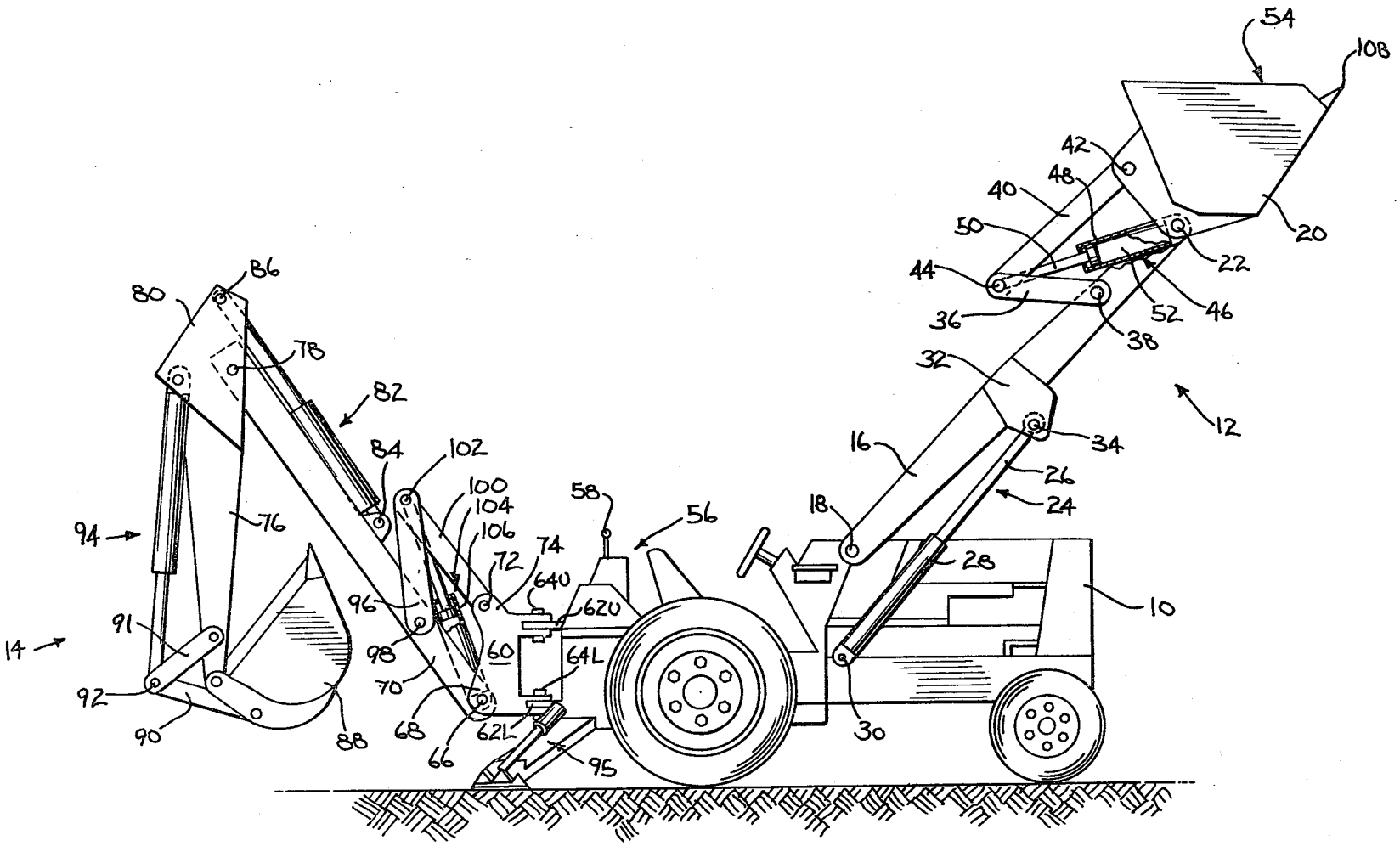
FIG. 1 is a side elevational view of a tractor having a backhoe and a bucket loader installed thereon using the mounting arrangement that is the subject of the present invention with the boom and the loader bucket raised upwardly.

While this invention is acceptable of embodiment in many different forms, there is shown in the drawings and will herein be described in detail several specific embodiments with the understanding that the present invention is to be considered an exemplification of the principles of the invention and is not intended to limit the invention to those specific embodiments illustrated.

FIG. 1 of the drawings generally discloses a combination backhoe and loader mounted on a tractor 10. The tractor 10 provides a support frame and a source of hydraulic power to operate the loader 12 and the backhoe mechanism 14. The components of the loader and the backhoe are, for the most part, duplicated on either side of the tractor 10; for this reason and to better describe the principles of the invention, only those components on the right side of the tractor 10 will be described in detail with the understanding that the description will likewise refer to an identical set of components located on the left side of the tractor. It should also be understood throughout this discussion that the various pivot pins and pivot shafts are held in place by snap rings and the like. Since these fittings are conventional and well known to those skilled in the art, they are not described in detail. Similarly, in order to simplify the drawings and better describe the invention at hand, they are not illustrated.

The loader mechanism 12 includes a lift arm 16 pivotally connected at one end to the tractor frame by a pivot pin 18 and pivotally connected at the opposite end to a bucket 20 by a pivotal connection means 22. The lift arm 16 is rotated or pivoted about the tractor 10 by the operation of a hydraulic actuator 24 (hereinafter alternatively referred to as the lift arm actuator) through the extension or retraction of a piston rod 26 extending outwardly from a hydraulic cylinder 28. In the drawings, this cylinder 28 is pivotally connected to the tractor 10 by a pivot pin 30. The piston rod 26 is disposed between and connected to a pair of downwardly extending reinforcing plates 32 by a pivot pin 34. The reinforcing plates 32 are secured to the lift arm 16 at a position intermediate the ends of the lift arm. Thus, it can be seen that when pressure is applied to the cylinder or head end of the piston within the lift arm actuator 24, the lift arm 16 will be rotated in a counterclockwise direction about pivot pin 18 to raise the bucket 20 upwardly. Conversely, when fluid is supplied to the piston rod side of the piston within the lift arm actuator 24, the lift arms will be rotated in the clockwise direction to lower the bucket 20.

The positioning of the bucket 20 relative to the upper end of lift arm 16 is accomplished by a hydraulically operated bucket positioning mechanism that is the subject of the present invention. In particular a first link 36 is pivotally connected to lift arm 16 by a pivot pin 38 at a position adjacent the upper end of the lift arm. A second link 40 is pivotally connected to the bucket by a pivot pin 42 and to the first link 36 by a second pivotal connection means 44. A hydraulic actuator 46 (hereinafter alternately referred to as the bucket actuator) is pivotally connected between the first pivotal connection means 22 and the second pivotal connection means 44. As shown in the drawings, the bucket actuator 46 has its cylinder end pivotally connected to the common pivotal connection 22 between the bucket 20 and the lift arm 16. The piston rod end of the bucket actuator is pivotally connected to the common pivotal connection 44 between the first link 36 and the second link 40.

In FIG. 1 the bucket actuator 46 is shown partially cut away to illustrate the relative position of its piston 48 and its piston rod 50 relative to its cylinder 52 when the bucket 20 is positioned relative to the lift arm 16 such that the opening 54 or the open end of the bucket is disposed upwardly. This position of the bucket 20 is often referred to as the "filled" position of the bucket. Thus, when the bucket is in its filled position the bucket actuator 46 is extended. The operation of the bucket actuator 46 and the associated links 36 and 40 will be explained in detail at a later point in this description.

The backhoe mechanism 14 is, for the most part, conventional. An operator's station 56 is located at the rear end of the tractor 10. A machinery operator or operating engineer faces a set of controls 58 when the backhoe mechanism 14 is operated.

The backhoe mechanism 14 includes a support arrangement in the form of a swing tower 60 pivotally mounted on rearwardly projecting tractor mounting brackets 62U and 62L by means of upper and lower swivel pins 64U and 64L which collectively define a common vertical axis. A swing cylinder (not shown) is used to rotate the swing tower 60 about this vertical axis.

The swing tower 60 carries a bottom horizontal pivot shaft 66 between two parallel walls or ears 68 projecting rearwardly from the swing tower. This pivot shaft 66 pivotally mounts a boom 70 to the lower end of the swing tower 60. An upper horizontal pivot shaft 72 is also carried by the swing tower 11. This shaft is also mounted between two rearwardly projecting ears 74 at the upper end of the swing tower 60.

A dipper stick 76 is mounted on a pivot shaft 78 carried at the upper end of the boom 70. This shaft defines the horizontal pivot axis of the dipper stick 76. The dipper stick 76 includes a rigid attachment plate 80 for receiving the pivot shaft 78 joining the boom 70 and the dipper stick 76. The dipper stick 76 is rotated relative to the boom 70 by a hydraulic actuator 82 (alternately referred to as the dipper stick actuator). As illustrated in the drawings, the cylinder end of the dipper stick actuator 82 is pivotally connected to the boom 70 by a pivot pin 84 located at a position intermediate the ends of the boom. The cylinder rod end of the dipper stick hydraulic actuator 82 is pivotally connected to the attachement plate 80 by a pivot shaft 86.

A backhoe bucket 88 is pivoted at the free end of the dipper stick 76 in the conventional way. Specifically, a pair of bucket drive links 90 and 91, pivoted to the bucket 88 and to dipper stick 76 respectively, are interconnected by a floating knee shaft 92. Another hydraulic actuator 94 pivotally connects the floating knee shaft 92 with the attachment plate 80. Finally, two stabilizer arms or outriggers 95 (only one being shown) are provided to stabilize the backhoe 14 when the boom 70 is rotated about the vertical axis of the swing tower 60.

The boom 70 is rotated about a horizontal axis relative to the swing tower 60 by a hydraulic actuator and linkage that is the subject of the present invention. Specifically, a first link 96 is pivotally connected to the boom 70 by a pivot pin 98 at a position intermediate the ends of the boom. A second link 100 is pivotally connected to the upper end of the swing tower 60 by a shaft 72. A pivotal connection means 102 pivotally connects the ends of the first link 96 and the second link 100. A hydraulic actuator 104 (alternately referred to as the boom actuator) is pivotally connected between the shaft 66 joining the boom 70 to the swing tower 60 and to the pivotal connection means 102 between the first link 96 and the second link 100. As illustrated in FIG. 1, the boom actuator 104 is shown partially cut away to show the relative position of its piston 106 when the boom 70 is disposed upwardly. Thus, the boom actuator 104 is extended when the boom 70 is raised.

The backhoe boom 70 and links 96 and 100 can also be mounted in the manner described by Long in U.S. Pat. No. 3,376,984 which is assigned to the assignee of the present invention. That patent describes a "overcenter backhoe" which allows the boom to be carried in a transport position which is generally vertically and slightly forwardly of the vertical axis of the swing tower. The center of gravity of a backhoe mechanism which is stored in a forward position is considerably improved over one not having an overcenter capability. Insofar as that mounting arrangement is concerned, the Long patent is hereby incorporated by reference for purposes of description. Those skilled in the art knowing the principles of the Long patent and the principles of the present invention will be able to combine those teachings.

Figure 2:
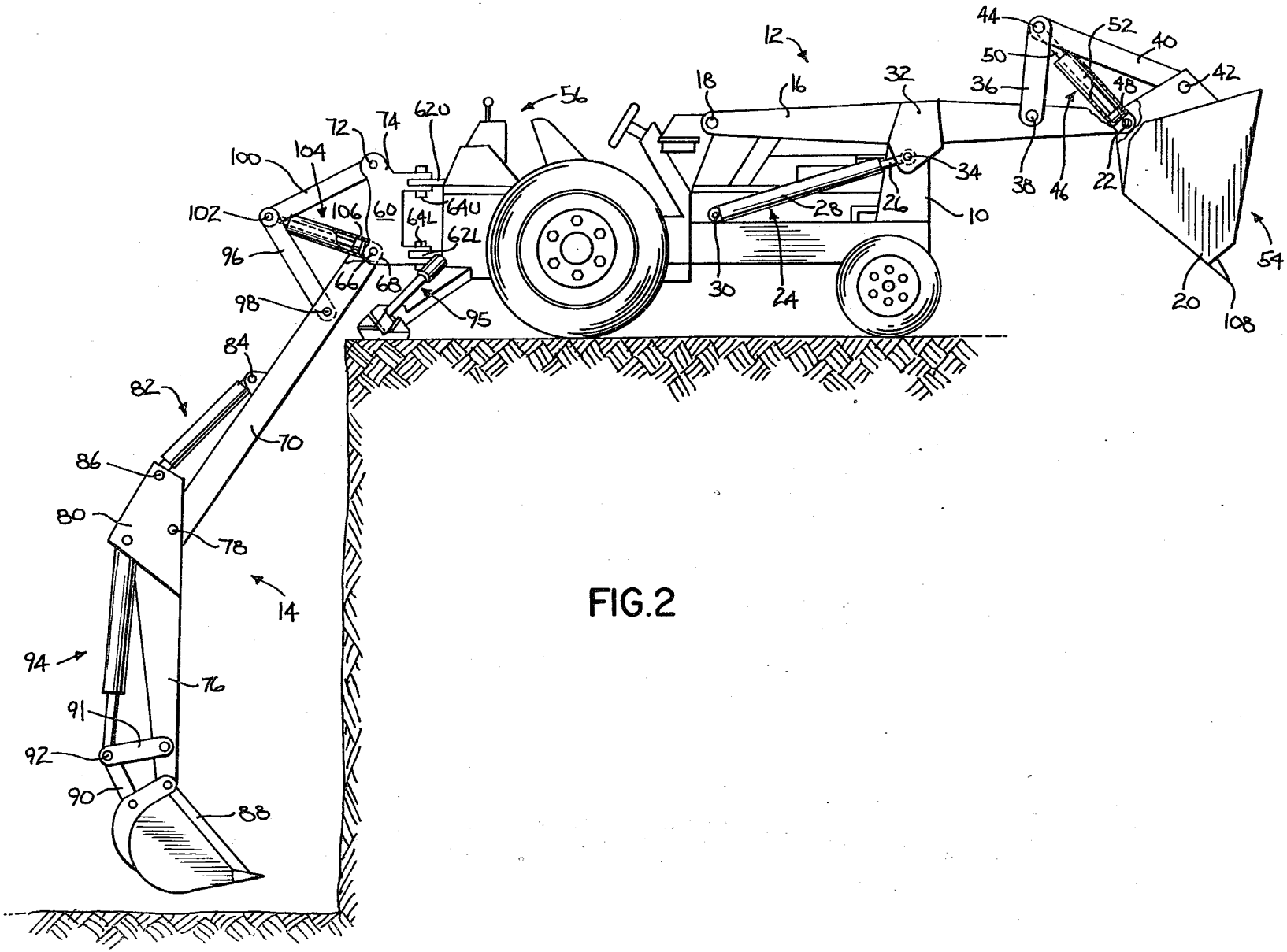
FIG. 2 is a side elevational view of the same apparatus shown in FIG. 1 with the boom and bucket lowered or disposed downwardly.

FIG. 2 illustrates the same tractor 10 with the loader mechanism 12 and the backhoe mechanism 14 lowered relative to the positions illustrated in FIG. 1. Specifically, the lift arm 16 has been rotated clockwise such that the lift arm is disposed generally horizontal with the bucket 20 at the front end of the tractor 10. This is the position of the lift arm 16 when the bucket 20 is about to be loaded.

The bucket actuator 46 in FIG. 2 is contracted relative to its position in FIG. 1. Referring to FIG. 1, it should be clear that when the bucket actuator 46 contracts, it forces the first link 36 to pivot clockwise and the bucket, by virtue of the second link 40, to pivot clockwise relative to the upper end of the lift arm 16. This forces the opening 54 in the bucket 20 downwardly such that whatever materials within the bucket are dumped. The position of the bucket 20 when the bucket actuator 46 is fully extended is often referred to as the "dumped position".

When the bucket 20 is positioned for filling, lift arm 16 would is lowered and the bucket actuator 46 is extended such that the bucket would be positioned intermediate its dumped and filled positions. This position is illustrated in FIG. 2; there the leading edge 108 of the bucket 20 is disposed generally horizontally and in the direction of the pile of material to be loaded. Thus, the bucket 20 is raised by pressurizing the cylinder or head side of the piston 48, and the bucket is dumped by pressurizing the piston rod side of the piston. Since the cylinder head side of the piston 48 is greater in area than the piston rod side of the piston, greater force is available to pivot the bucket upwardly when the bucket actuator 46 is positioned as shown in the drawings. Similarly, since the piston rod 50 occupies a portion of the interior of the cylinder 52, the amount of hydraulic fluid needed to contract the bucket actuator 46 is less than that amount of hydraulic fluid necessary to extend the hydraulic actuator. Thus, the dumping speed of the bucket 20 is increased when the bucket hydraulic actuator is mounted in the manner illustrated in the drawings.

Referring to FIG. 2, it should be appreciated that the boom 70 is raised upwardly in a clockwise direction about the pivot shaft 66 joining the boom to the swing tower 60 by forcing the first link 96 and the second link 100 together in "scissors like fashion". This, of course, is accomplished by extending the boom actuator 104. Since the cylinder head end of the piston 106 is pressurized to extend the boom actuator 104, the force available from the boom actuator in raising the boom 70 is comparatively greater than that force provided by the boom actuator when lowering the boom. Similarly, since the piston rod end of the piston 106 in the boom actuator 104 is pressurized when contracting the boom actuator, the relative speed at which the boom 70 is returned to the dig position (i.e. bottom of the trench) is comparatively greater than that speed at which the boom is raised. Thus, the inherent capabilities of a hydraulic actuator are maximized or used to their optimum extent with the linkage and mounting arrangement shown in the drawings.

It should also be appreciated that the linkage used to operate the bucket 20 at the end of the lift arm 16 is comparatively rigid when the hydraulic actuator 46 used to operate that linkage is contracted. This is because the seals at the piston rod end of the actuator and the rings around the piston 48 provide uniform support to the piston rod at both ends of the cylinder. In contrast, when the bucket actuator 46 is extended, the seals around the piston rod 50 and the seals or rings around the piston 48 are comparatively close to each other and at one end of the cylinder such that the piston rod is supported at only one point along its length. Since the bucket actuator 46 is essentially contracted when the bucket is aligned to be thrust into a pile of material for loading (i.e., see FIG. 2), the overall stress placed upon the sealing members of the hydraulic actuator is relatively low. Thus, the mounting arrangement shown in the drawings incorporates the inherent strength or rigidity of a hydraulic actuator. Finally, since the piston rod is housed in the cylinder when the bucket is being loaded or filled, the smooth surfaces of the piston rod are protected from dirt and debris falling from the bucket, in the case of a loader, or the walls of the trench, in the case of a backhoe.

While the invention has been described in conjunction with two specific embodiments, it is evident that there are other alternatives, modifications, and variations which will be apparent to those skilled in the art in light of the foregoing description. For example, although a single hydraulic actuator has been used in the various embodiments illustrated, two hydraulic actuators and two sets of linkages can be used to operate the boom or the bucket. An additional set of parallel links or hydraulic actuators, particularly in the case of a wide bucket loader, improves the overall balance of forces and stresses imposed upon the various moving components. Pedersen, U.S. Pat. No. 4,037,743 describes a hydraulic system which is particularly useful with the mounting arrangement which is the subject of the present invention. Similarly, the teachings of Long, U.S. Pat. No. 3,220,580 can be utilized with the loader arrangement to provide a self-leveling feature to the bucket. Moreover, the principles of the invention are also applicable to other earth moving implements besides backhoes and loaders, employing a pivoted boom or arm actuated by a hydraulic actuator or motor. Accordingly, it is intended to cover all such alternatives, modifications, and variations as set forth within the spirit and broad scope of the appended claims.

What is claimed is as follows:

1. Apparatus for operating a bucket between a loaded and a dumped position, said bucket being pivoted to a lift arm by first pivotal connection means, comprising:

(a) a first link pivotally connected at one of its ends to said lift arm at a spaced distance from said first pivotal connection means;

(b) a second link pivotally connected at one of its ends to said bucket at a spaced distance from said first pivotal connection means and disposed towards said first link;

(c) second pivotal connection means, for pivotally connecting the opposite ends of said first link and said second link; and (d) extensible means, pivotally connected at one of its ends to said first pivotal connection means and pivotally connected at its opposite end to said second pivotal connection means for moving said second pivotal connection means towards and away from said first pivotal connection means, said extensible means comprising a hydraulic actuator having a cylinder, a piston disposed to move reciprocally within said cylinder and a piston rod connected to said piston, one end of said cylinder being pivotally connected to said first pivotal connection means and the free end of said piston rod being pivotally connected to said second pivotal connection means, whereby the head side of said piston is pressurized to extend said hydraulic actuator and move said bucket from its dumping position to its loaded position, and contraction of said hydraulic actuator pivots said bucket to its dumped position relative to said base member, and thus the available force pivoting said bucket from its dumped to its loaded position is greater than the force used to pivot said bucket from its loaded to its dumped position.

* * * * *